US005966742A

United States Patent [19]

Cunliffe

[11] Patent Number: 5,966,742

[45] Date of Patent: Oct. 19, 1999

[54] ADJUSTABLE CAP

[75] Inventor: Stephen E. Cunliffe, Rancho Santa Fe, Calif.

[73] Assignee: American Manufacturing Concepts, Inc., Chula Vista, Calif.

[21] Appl. No.: 09/231,473

[22] Filed: Jan. 14, 1999

[51] Int. Cl.[6] ..... A42B 1/22

[52] U.S. Cl. ..... 2/195.3; 2/181; 2/183

[58] Field of Search ..... 2/181, 183, 195.2, 2/195.3, 417, 418

[56] References Cited

U.S. PATENT DOCUMENTS 4,274,157 6/1981 Boden .
4,491,985 1/1985 Dalton .
4,662,007 5/1987 Lipkin .
4,856,116 8/1989 Sullivan .
4,941,210 7/1990 Konucik .
5,025,504 6/1991 Benston et al. .
5,099,524 3/1992 Linday ..... 2/181
5,608,917 3/1997 Landis et al. .
5,615,415 4/1997 Beckerman .
5,715,540 2/1998 Cho .

*Primary Examiner*—Diana L. Oleksa
*Attorney, Agent, or Firm*—Brown Martin Haller & McClain LLP

[57] ABSTRACT

An adjustable cap has a crown portion shaped for fitting over the crown of a wearer's head, with the rear part of the crown portion formed of a stretchable material. A two part peripheral band is secured around the lower peripheral edge of the crown portion on the inside of the cap. The first, front part of the band is of a moisture absorbent, non-stretch material, and the second, rear part extending across the rear of the crown portion is of a stretchable material. The rear part of the band stretches to adjust the size of the peripheral opening to fit wearer's of differing head sizes.

7 Claims, 1 Drawing Sheet

ADJUSTABLE CAP

BACKGROUND OF THE INVENTION

This invention relates generally to hats or caps, and is particularly concerned with a cap or hat which is adjustable in size to fit wearers having different head sizes.

Adjustable caps are known which have an opening at the rear of the crown portion, with straps extending from opposite sides of the opening. One of the straps has a plurality of spaced openings, while the other cap has spaced studs which can be inserted through any selected pair of openings in order to adjust the size of the cap. Fitting such caps to a wearer's head can be inconvenient, since the cap must first be tried, then removed to adjust the straps, and subsequently re-fitted as necessary until the most comfortable fit is achieved.

In U.S. Pat. Nos. 5,615,415 of Beckerman and 5,715,540 of Cho, an alternative arrangement is described in which a peripheral band extending around the entire periphery of the base opening of the cap is formed of a stretchable or elasticated material. This will automatically adjust to fit the wearer's head as the cap is pulled down over the crown of the head. The fabric forming the band is of a uniaxially stretchable material.

SUMMARY OF THE INVENTION

It is an object of the present invention to provide a new and improved adjustable cap or hat.

According to the present invention, an adjustable cap is provided, which comprises a crown portion shaped for fitting over the crown of a wearer's head, the crown portion having a front part, a rear part, and opposite sides, and the rear part of the crown portion being formed of a stretchable material, the crown portion having a lower peripheral edge defining a head receiving opening, and a peripheral band secured around the lower peripheral edge on the inside of the cap, the peripheral band having a rear portion extending across the rear part of the crown portion and a separate front portion extending across the front part of the crown portion, the front portion of the band comprising a moisture absorbent, non-stretch material, and the rear portion comprising a stretchable material, wherein the rear portion of the band only stretches to adjust the size of the peripheral opening to fit wearer's of differing head sizes.

Preferably, the material forming the rear portion is a bi-axially stretchable material. The rear portion of the band has opposite ends secured to the corresponding ends of the front portion by stitching or the like. This arrangement provides the advantages of a non-stretchable, sweat absorbent material in the front portion of the band with adjustability to different head sizes by means of the stretchable, rear portion of the band.

The crown portion is preferably formed from a plurality of generally triangular gores which are sewn together along their side edges with the apices meeting at the crown of the cap. Preferably, the gores forming the front part of the crown portion are of substantially non-stretchable, more rigid material, whereas the gores forming the rear part of the cap are of stretchable material, permitting stretching in this region to accommodate stretching of the rear portion of the peripheral band.

In a preferred embodiment of the invention, the rear portion of the band is a single layer of bi-axially stretchable fabric, while the front portion is of multi-layer construction, comprising a central core layer of porous, foam-like absorbent material and outer cover layers of fabric.

The adjustable cap of this invention combines the advantages and comfort of a sweat or moisture absorbent band at least at the front of the wearer's head, with adjustability for the purpose of fitting easily onto different size heads.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

Figure 1:
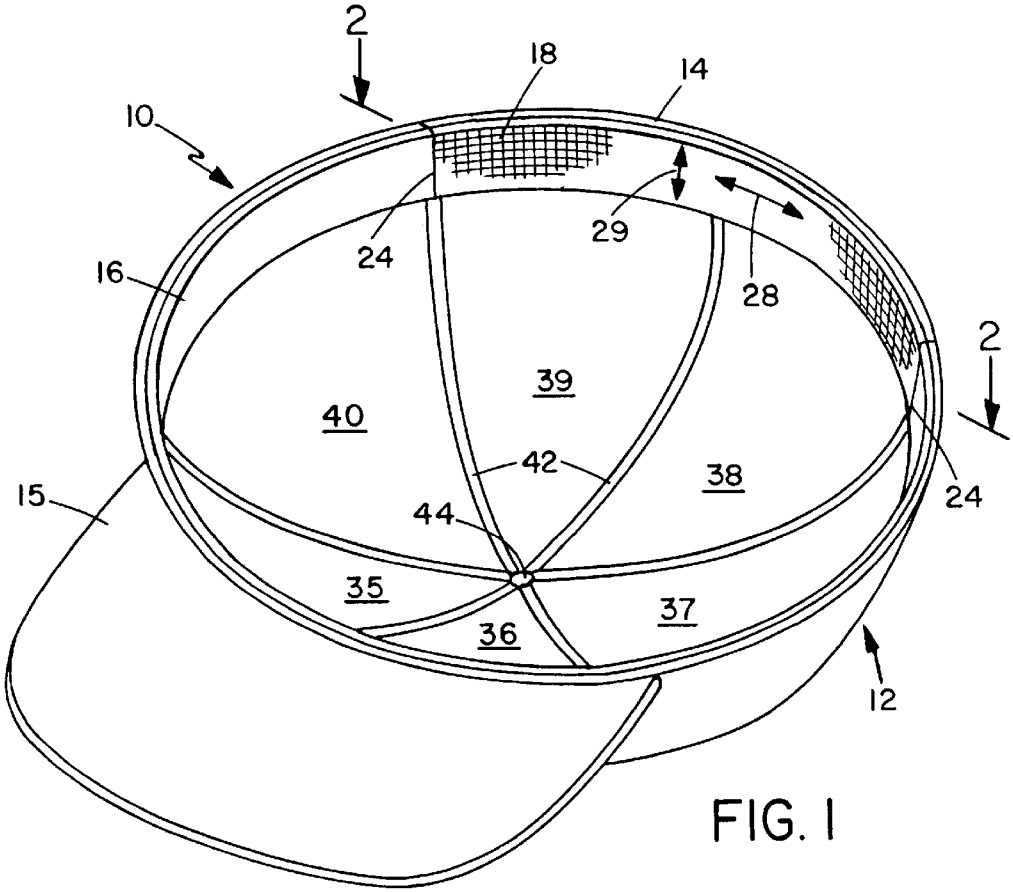
FIG. 1 is a perspective view of the cap according to a preferred embodiment of the invention, showing the elastic rear band.
Figure 2:
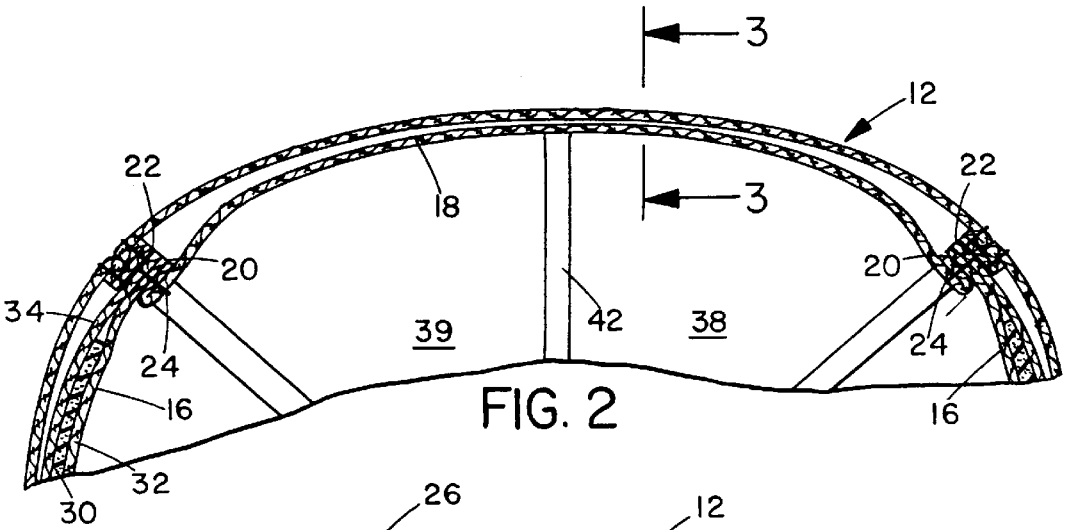
FIG. 2 is an enlarged sectional view taken on line 2—2 of FIG. 1.
Figure 3:
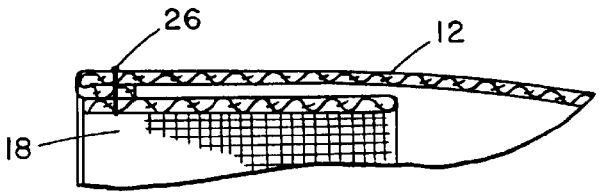
FIG. 3 is a further enlarged sectional view taken on line 3—3 of FIG. 2.

FIGS. 1 to 3 of the drawings illustrate an adjustable cap 10 according to a preferred embodiment of the present invention. Cap 10 basically comprises a crown portion 12 for fitting over the crown of a wearer's head, the crown portion having a lower peripheral opening 14, and a bill or visor is projecting from the front part of the cap. A two-part peripheral band extends around the peripheral opening 14 on the inside of the cap. The band has a first, front portion 16 of a multi-layer, sweat absorbent material, and a second, rear portion 18 of a single layer, stretchable material.

The opposite ends 20 of the rear portion 18 of the band are secured to the corresponding opposite ends 22 of the front portion 16 via lines 24 of stitching, as illustrated in FIGS. 1 and 2. Both portions 16,18 are secured to the lower peripheral edge of the opening 14 via stitching 26, as illustrated in FIG. 3, leaving the upper edge of each band portion free.

The stretchable material of rear portion 18 of the band is preferably bi-axially stretchable, i.e. stretchable both in a direction 28 around the periphery of the cap and in a transverse direction 29, as indicated by the arrows in FIG. 1. The material of portion 18 may be a fabric woven from perpendicular warp and weft yarns of 80% polyester and 20% rubber or the like.

The front portion 16 is of multi-layer construction, as indicated in FIG. 2. Portion 16 has a core layer 30 of a porous, moisture absorbing foam material which also has cushioning properties, outer cover layer 32 of an absorbent fabric material which faces the wearer's head when the cap is worn, and an inner liner layer 34.

The crown portion 12 of the cap is formed from a plurality of generally triangular panels or gores 35,36,37,38,39, and 40 which are sewn together along their adjacent side edges to form seams 42, and which have apices meeting at the crown 44 of the cap. The two panels 35,36 form the front of the cap, and are preferably of a relatively rigid or stiffened material to maintain the cap shape. At least the two rear panels 38,39 are formed from a stretchable fabric material so that they can stretch along with rear portion 18 of the peripheral band to adjust the size of the cap to different head sizes. The two side panels 37 and 40 may also be of stretchable material.

With this arrangement, the advantages in comfort of a moisture absorbent, cushioning sweat band are maintained while still allowing adjustability for fitting over different head sizes, unlike prior art arrangements where the entire peripheral band was stretchable. Preferably, the front, sweat absorbent portion 16 extends over the front and sides of the cap, i.e. around the peripheral edges of panels 37,36,35 and 40, while the stretchable rear portion extends across the rear panel edges only. Thus, the rear, stretchable band portion has a length of approximately ⅓ that of the cap peripheral opening, while the front, sweat band portion has a length of approximately ⅔ of the length of the peripheral opening. This provides sufficient adjustability while allowing maximum comfort to the wearer due to the extension of the sweat absorbent portion over the front and sides of the cap.

Although a preferred embodiment of the invention has been described above by way of example only, it will be understood by those skilled in the field that modifications may be made to the disclosed embodiment without departing from the scope of the invention, which is defined by the appended claims.

I claim:

1. An adjustable cap, comprising:

a crown portion shaped for fitting over the crown of a wearer's head, the crown portion having a front part, a rear part, and opposite sides, and the rear part of the crown portion being formed of a stretchable material;

the crown portion having a lower peripheral edge defining a head receiving opening;

a two-part peripheral band secured around the lower peripheral edge on the inside of the cap, the peripheral band having a rear portion extending across the rear part of the crown portion and a separate front portion extending across the front part of the crown portion, the front portion of the band comprising a moisture absorbent, non-stretchable material, and the rear portion comprising a stretchable material, wherein the rear portion of the band stretches to adjust the size of the peripheral opening to fit wearer's of differing head sizes; and the rear portion of the band is formed from a bi-axially stretchable material.

2. The cap as claimed in claim 1, wherein the front portion of the band extends around the front and sides of the crown portion and the rear portion of the band extends around the rear part only of the crown portion.

3. The cap as claimed in claim 2, wherein the rear portion of the band extends around approximately one third of the lower peripheral edge of the cap.

4. The cap as claimed in claim 1, wherein the front and rear portions of the band each have opposite ends, each end of the rear portion being secured to the respective end of the front portion by stitching.

5. The cap as claimed in claim 1, wherein the crown portion is formed from a plurality of generally triangular gores which are sewn together along adjacent side edges with the apices meeting at the crown of the cap, the gores forming the front part of the crown portion being of substantially non-stretchable material and the gores forming the rear part of the cap being of stretchable material.

6. The cap as claimed in claim 1, wherein the rear portion of the band is a single layer of bi-axially stretchable fabric.

7. The cap as claimed in claim 6, wherein the front portion is of multi-layer construction, comprising a central core layer of porous, foam-like absorbent material and outer cover layers of fabric material.

* * * * *